United States Patent [19]

Rasmussen

[11] Patent Number: 4,728,546

[45] Date of Patent: Mar. 1, 1988

[54] METHOD AND SUBSTANCE FOR PROTECTION OF FREE METALLIC SURFACES, ESPECIALLY STEEL SURFACES AGAINST CORROSION

[76] Inventor: Øystein E. Rasmussen, Hosleveien 119, N-1340, Berkkestua, Norway

[21] Appl. No.: 786,180

[22] Filed: Oct. 10, 1985

Related U.S. Application Data

[63] Continuation-in-part of Ser. No. 595,904, Apr. 2, 1984.

[30] Foreign Application Priority Data

Apr. 6, 1983 [NO] Norway ..... 831212
Sep. 5, 1983 [NO] Norway ..... 833165

[51] Int. Cl.[4] ..... B05D 3/02

[52] U.S. Cl. ..... 427/409; 106/14.05; 106/14.34; 148/6.14 R; 148/6.15 R; 427/239; 427/388.2; 427/393.6; 427/407.1; 428/36

[58] Field of Search ..... 427/409, 407.1, 393.6, 427/388.2, 239; 106/14.05, 14.34; 148/6.14 R, 6.15 R; 428/36

[56] References Cited

U.S. PATENT DOCUMENTS 4,273,833 6/1981 DeLong ..... 428/411

*Primary Examiner*—Thurman K. Page
*Attorney, Agent, or Firm*—Owen, Wickersham and Erickson

[57] ABSTRACT

In order to protect free surfaces, especially steel surfaces against corrosion, a water layer is applied thereto, binding it to the surface by means of a gel-forming hydrophilic material which is essentially insoluble in water. The hydrophilic material is preferably a polymer or an inorganic, gel-forming composition. The method may be used for protection of offshore constructions, ships, the ballast tanks of ships, iron and steel pipelines, and the like. It may also be used to coat the interior of asbestos cement pipe to prevent asbestos pollution of a liquid to be conducted by the pipe.

24 Claims, No Drawings

METHOD AND SUBSTANCE FOR PROTECTION OF FREE METALLIC SURFACES, ESPECIALLY STEEL SURFACES AGAINST CORROSION

REFERENCE TO RELATED APPLICATION

This application is a continuation-in-part of application Ser. No. 595,904, filed Apr. 2, 1984 now abandoned.

The invention relates to a method for protection of free surfaces. It relates especially to the protection of metallic surfaces against corrosion, whereby the surfaces are kept in a wet condition. It also relates to coating non-metallic, wet surfaces, such as the inner surface of asbestos pipes. It further relates to ship protection, pipe coating and other protected articles.

BACKGROUND OF THE INVENTION

Metallic surfaces which are constantly immersed in water can be given very effective protection against corrosion by simple and relatively cheap means. With the use of cathodic protection in the form of sacrificial anodes or in the form of impressed current, large steel structures can be kept free from corrosion. For this reason, drilling platforms and production platforms are normally not painted on the areas which are submerged in water. Ships with effective cathodic protection can be completely free from corrosion even on large areas of a flat bottom where the paint has been removed after touching bottom.

These examples show how effective cathodic protection of metal can be under water. Also, buried pipe lines and tanks, both offshore and onshore, can be protected by the use of cathodic protection, even though in this case normally combined with coatings of different types.

Tanks, containers, and pipe lines used with circulating water, for instance, can be protected inside by the addition of inhibitors, either inorganic or organic. The term "inhibitors" includes substances which remove oxygen from the water, such as sodium sulfite and hydrazine. Corrosion protection can also be obtained by making the water alkaline.

On surfaces in open air, particularly in marine and industrial environments, other normally more expensive methods must be used. On steel, the most usual method is galvanizing or painting, or eventually a combination of the two. In these cases the steel must normally be either pickled or sandblasted prior to the application of the corrosion preventing coating.

However, corrosion problems are particularly serious on surfaces in marine or industrial environments which are alternately dry and wet. Examples are the splash zones on structures in the sea, pipes, and tunnels, and the like which are particularly exposed to condensation. On such surfaces paints, for example, perform very poorly.

Asbestos cement pipes lead to a different type of problem, such as danger to people where the water supply can pick up asbestos pollution. The coating of asbestos cement pipes has heretofore been difficult; for many coatings are themselves dangerous and most of them require drying the pipes, for wet surfaces are difficult to coat effectively.

SUMMARY OF THE INVENTION

The present invention aims at solving the practical and not the less the economical problems connected with the coating of various surfaces and the protection of iron, steel and steel alloy surfaces and other metallic surfaces, such as aluminum and zinc and their alloys, especially when the surfaces are not submerged more or less constantly in water, by ensuring that the surfaces, for either the whole time or at least for a considerable part of the time, are covered with a layer of water of sufficient thickness.

These problems are solved by the method and the composition of matter described in the claims.

The term "free surfaces" is here meant to include uncovered surfaces and other surfaces which lie open to the environment, i.e., are not embedded within another material. However, the term includes corroded surfaces.

The method of the present invention comprises the binding of the free surface of a water layer of sufficient thickness. This is done with the help of hydrophilic polymers and/or already known inorganic gel-forming substances, such as metal salt gelling agents, either by increasing the viscosity of the water to such an extent that it does not run off the surface, or by cross-linking, understood in the widest significance of the word. Examples are known of cross-linked hydrophilic polymers, for instance, which can bind up to 49 times their own weight of water.

The invention is not limited to the method for protecting surfaces, but also includes some compositions of matter used for the protection, and a ship having ballast tanks protected according to the method.

PREFFERED EMBODIMENTS OF THE INVENTION

Among hydrophilic polymers well suited for the method are (1) such natural polymers as arabic, tragacanth and karaya gums, (2) semi-synthetics such as carboxymethyl cellulose, methylcellulose and other cellulose ethers, lignin derivatives, as well as different types of modified starches (ethers and acetates) and (3) synthetics such as polyacrylic acids, polyacrylamides, polyethylene oxide, polyvinyl pyrrolidone, polyethyleneimine (aziridine) and others, as well as combinations of these between themselves or with other substances. There exist many hydrophilic polymers which can be used with the method, and the above enumeration is not to be considered as complete.

The particular conditions of technical, practical and economical character of the different areas of application will be decisive for which types of hydrophilic polymers will be preferred. The characteristic common denominator is the property to bind a sufficient quantity of water in the form of a gel to the free metalic surface so that the surface is covered by a continuous water film.

The gel-forming hydrophilic polymers can be applied as monomers, dimers, trimers or prepolymers, which are polymerized or cross-linked during the blending and application process and in situ. Examples of this are polyacrylamide applied as acrylamide, polyacrylate as acrylate, aminoplast and urea-plast as urea/formaldehyde, resorcinol/formaldehyde, tannin/formaldehyde, melamine formaldehyde etc.

Examples of inorganic gel-forming substances, which can either be used alone to form a gel-like water layer on the surface or in combination with hydrophilic polymers, are silicic acid, aluminum hydroxide, and bentonite.

Besides pure ingoranic gels of, for instance, silicates, alumina, magnesia, magnesia/bentonite etc. there are also combined organic/inorganic gels which are well suited for the method.

An extensive patent and other literature is known that teaches treating gels for the stabilization of soils and for oil drilling. The major part of these gels may be used with the method of the present invention.

The method of this invention has the very special peculiarity that it is actually an advantage for certain applications if the surface is already corroded, as the corrosion products participate to make it possible to bind a thicker water layer on the corroded surface than on a smooth non-corroded surface. Water-soluble corrosion products can also be utilized in the method to participate in the cross-linking of the hydrophilic polymers.

For applications where the surface is under water containing salts for the whole time or a great part of the time, the method has the effect of an enrichment of ions in the gel compared with the salt-containing water outside the gel. This higher concentration of ions affords an added conductivity for direct current and consequently a better distribution of the cathodic protection. This is particularly important for areas of the structure with a complicated configuration, where it can be difficult to accommodate the anodes properly, but the gel generally affords a lower current density demand for the same degree of cathodic protection.

For applications where periods of high humidity alternate with dry periods, the gel-like layer of water can be cross-linked particularly strongly on the surface so that the evaporation is as low as possible.

A gel-like water layer in accordance with the method will in itself reduce the rate of corrosion by reducing the diffusion of oxygen to the surface. Further corrosion protection can be obtained by combining the method with one or more of the already known methods for the protection of surfaces which are constantly immersed in water, i.e., cathodic protection, addition of corrosion inhibitors, regulation of pH etc.

On surfaces which are parts of a larger surface, of which some is immersed in water and on the immersed part is equipped with cathodic protection, the effect of the cathodic protection is extended to at least a part of the surface which has been treated in accordance with the method. This applies to the different splash zone. For instance, ballast tanks in ships exemplify applications where cathodic protection can be extended to areas which are not immersed in water, with the help of anodes below water.

A metallic surface to be protected by the method of the invention can first be coated with a metal which is anodic relative to the surface, such as zinc powder, and thereafter be coated with hydrophilic polymers and water to form a gel. The applied metal particles will then act as anodes and afford cathodic protection to the surface.

The hydrophilic gel-forming substances can be applied in two stages. On steel, as an example, first a cationic polymer may be applied and thereafter an anionic gel-former. As examples of such a combination can be mentioned polyethyleneimine (aziridine), a cationic polymer, and calcium lignin sulfonate cross-linked with a dichromate as an anionic gel-former.

On certain metals, such as aluminum and zinc, the opposite sequence can be advantageous.

Many surfaces in addition to being exposed to corrosion are also exposed to mechanical wear and tear. This is the case, for one thing, for the underside of vehicles such as cars. Such areas can consequently be in need of protection also against mechanical stresses. This can then be obtained either by preformed types of coatings, such as plastic covers under the mudguard on cars, or by reinforcing the gel-like water layer in situ on the surface, e.g., with the use of polyurethane foam and similar materials.

The application of the hydrophilic polymers can be made by using already known methods, with the gel being formed by water already present on the surface or by water applied to the surface afterwards. Hydrophilic polymers can, for instance, be applied in the form of powders by electrostatic spray equipment, or they can be applied as a dispersion, or as a solution. The application can be made with airless spray equipment.

Hydrophilic polymers can be cross-linked either by using a combination of one strongly anionic and one strongly cationic type or by the use of known crosslinking agents, examples of which are poly-functional water-soluble metals and di- or multifunctional organic substances. The most usual cross-linking agents are mentioned in the literature on the different types of hydrophilic polymers. The degree of cross-linking can be adjusted so as to obtain the best combination of mechanical properties and water-binding properties.

The hydrophilic polymers can eventually be combined with, for instance, fibrous fillers which can impart to the gel-like water layer greater mechanical strength, or porous fillers such as Aerosil, which for one thing can add to the binding of water to the surface, or with other substances which give technical or economical advantages.

Asbestos cement pipes for drinking water have resulted in asbestos pollution of the water. It is often necessary or at least desirable to undertake a reconditioning of such pipes in order to avoid further asbestos pollution. Cast iron pipes which have been in service for a long time tend to get tuberculation and incrustation due to the corrosion process. Heretofore, this has required plugging of the pipe conduits, drying them, and then applying an epoxy composition, or a cement composition or lining the pipe with a plastic pipe.

According to the present invention, the pipe conduit or a section thereof can be filled with the gel-formed hydrophilic material for a certain time period, to result in a covering that will remain on the inner pipe surface. Alternatively, the material may simply be sprayed on to the surface to provide the coating. An important advantage of this invention resides in that this coating can be applied on a set surface.

Example Of Use In Ballast Tank

All types of ships have ballast tanks, and in all ballast tanks corrosion problems arise. In side tanks which are used as ballast tanks, for instance in tankers, it is found that the corrosion rate at the top of the tank is double the corrosion rate at the bottom of the tank. This is correlated to the fact that the steel surface at the top of the tank is not permanently submerged in water, even when the tank is filled with ballast water, and thus these upper steel surfaces are either partly over or below the water surface, due to the recurring waves in the tank, or the surfaces may be sprayed with water from the waves in the tank. This alternation between air and sea water has the effect that such steel surface is in contact with more oxygen than are surfaces which are permanently submerged in sea water for the same time period.

This fact is accepted in such a degree by the classification companies that they require an addition to the thickness of the steel plates at the top of the tank due to the expected corrosion, requiring an extra plate thickness of 3 mm at the top of the tank against 1–1.5 mm at the bottom of the tank. Even if the tank is empty there is a relative humidity of substantially 100% in a ballast tank, or close to 100%, for there will normally be some water left in the tank and on the corroded tank walls, and the transport of air into and out of the tank is insufficient to remove the humidity in the tank.

In ballast tanks and corresponding conditions it is always necessary to expect wet surfaces on the walls. Under conditions with wet steel surfaces and 100% relative humidity in the atmosphere, it is not possible to rely on paint based on solvents or on water, for the solvent is not able to evaporate and a normal film of painting is not built up. It has heretofore been necessary to use solvent-free coatings, for instance coatings based on oil or fat which, however, disintegrate rather quickly and are removed by the washing action of the water in the tank.

With the present invention it has been found that a permanent or "not moved" water body gives less transport of oxygen to the steel surface than air saturated with moisture or water in quick movement.

In a ballast tank, since the walls of the tank are exposed to mechanical wear and tear from the waves which built up in the tank, the water-based gel thus must have a high mechanical resistance. This can best be achieved by using polymerization in situ as a method for building a resistant gel. As examples for this may be mentioned ligninsulfonate which has been made into a polymer and has been cross-linked with a dichromate and a formaldehyde resin, for instance melamine formaldehyde, made to a polymer by a reduction of the pH.

Requirements of high mechanical strength, especially against wear from streaming water, are also found on the inside of water and gas pipes. In contrast, water tanks on land require little mechanical strength and thus it is possible to use soft gel compositions satisfactorily.

Gel Coatings That May Be Used

All tests which have been made have shown that the water is the *most important* part of the gel coating. It is the water which gives transport of ions through the coating; this transport is necessary in order to avoid the osmotic pressure which can build bubbles in the coating. Some gel-forming substances give better gels than others, but in principle all of them give acceptable results, dependent on the requirements of use with respect to the mechanical strength for the coating and to other requirements, such as easy coating, pot life, etc. As examples which have been used in practice I can mention the following:

EXAMPLE 1

2 percent by weight of Na-bichromate (solids content in water solution) is added to 25% by weight of Ca-ligninsulfonate (solids content in water solution) and 3% by weight of "micro-mica", a known mineral that is a hydrous silicate of potassium and aluminum. The substances are mixed and diluted to give a total water content of 70% and are sprayed on a steel surface with high pressure spray equipment.

EXAMPLE 2

10 percent by weight of phosphoric acid, in water solution, is added to 40 percent by weight of melamine-formaldehyde resin, in water solution, and 3 percent by weight of micro-mica and diluted to a total of 47% water content and are sprayed on the steel surface with high pressure spray equipment.

EXAMPLE 3

25 percent by weight urea-formaldehyde resin, in water solution, is added to 25 percent by weight polyethyleneimine resin, in water solution, in a ratio of 1:1, and then mixed with 3 percent micro-mica and diluted to 47% water content. The mixture is then sprayed on the steel surface with high pressure spray equipment.

The invention is intended for use only in areas which are or can be held in a condition where they are saturated with moisture or humidity. Probably, the most important uses will be in ballast tanks on ships and on the inside surfaces of pipes carrying water or other liquids or gases causing corrosion problems. The invention is mainly intended for use on inside walls, not on outside walls.

As noted, the examples contain two principal components—hardener and pre-polymer or anionic polymer and a cationic polymer. Particularly to be noted are (1) the full-spectrum viscosity range of one and the same product (2) the substantially complete insolubility of the cured product. These two properties are unique to these products, and together with the hardness of the cured coating make it very special as a maintenance coating for water ballast tanks and a reconditioning coating for pipelines.

Two containers, one for each of the two principal components, are used for storage, the two components are mixed before use and stirred until the mixture is homogeneous. Then the pigment, e.g., micro-mica is added. For some time after mixing the viscosity remains very low. At this low viscosity the composition easily penetrates into the pores in the rust as well as into cavities behind rust scale.

Gradually the viscosity increases. At these higher viscosities the material clings to vertical surfaces and to underneath horizontal surfaces, making it easy for the operator to build up a continuous film of the required thickness.

The solid material, even when held under running water, sheds the water. This illustrates how seawater and condensation are prevented from penetrating the coating and reaching the intact steel beneath the rust.

The preferred materials are preferably stored and applied at about 20° C. for the best viscosity curve. The person applying the material should use a respirator hood when in a tank and should use goggles during the mixing operation to protect his eyes against splash.

Spraying preferably is started at the top of a tank with fresh mixed material and applied so copiously that the material runs down the tank walls, in order to saturate the rust and fill up any cavities behind rust scale. Then the operator waits for a time while monitoring the viscosity increase, and applies a second coat wet-in-wet at a conveniently high viscosity, to build up a film thickness of 150–200 microns.

The material should then be allowed to cure for a few days before filling the tank with seawater. During the first ballast trip thereafter, the tank should be kept as full as possible, so that all of the coated areas are immersed.

It is important to maintain a water saturated atmosphere in the tank to prevent evaporation of the gelled water in the coating.

The basic concept of the invention is to keep the free metal surface constantly covered with stagnant seawater of such a high viscosity that there is no movement relative to the steel surface whatsoever. When the steel is covered with a continuous film of gel according to the invention, the supply of oxygen to the steel surface is determined by the diffusion rate of oxygen through the film, which is about one order of magnitude less than for fast-moving seawater or splash.

When a tank has been coated with any of the materials of Examples 1–3, the ullage space and the splash zone, as well as the other areas of the tank, all have the same low corrosion rate, which can be reduced even further if need be by combining the gel coating with sacrificial anodes or impressed current.

The preferred coating material is water-based and two-component. This means that the polymer solution will mix with the water present in the rust, and it will cure in the damp atmosphere to a solid hard coating in which water has become an integral component which imparts several desirable properties, flexibility and ionic conductance being among the most important.

The material can be applied with either normal paint spray equipment or water-washing equipment with paint spray nozzles. It is recommended to use a pump with 10 liter per minute capacity and 100 kp/cm$^2$ pressure or higher.

Typical coating material may be supplied in standard pallet units of 500 kg, consisting of 4 open top plastic drums with the hardener component and the pigments in individual containers inside each drum.

The coverage is 3–4 m$^2$/kg, and recommended surface treatment before application is Butterworthing or other high-pressure spray cleaning and removal of silt and debris.

From the reported weight loss figures, the rates of corrosion for steel panels *without* rust before coating application has been calculated.

Highest rate of corrosion for one single panel: 29 microns/year

Lowest rate of corrosion for one single panel: 4 microns/year

Median rate of corrosion for all panels: 10 microns/year (Area 300 cm$^2$/panel, exposure time 55 days or 88 days).

The median rate of corrosion is about 1/10th of the rate expected when steel without protection is exposed in seawater.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. A method for coating a free previously uncoated surface selected from the group consisting of metallic surfaces and asbestos cement surfaces, comprising, keeping the surface in a wet condition by binding a water layer to the surface by means of a gel-forming hydrophilic material, which after gelling and cure is essentially insoluble in water.

2. A method according to claim 1 comprising applying the material to a wet, free metallic surface.

3. The method according to claim 2 wherein the gel-like water layer contains corrosion inhibitors.

4. A method according to claim 1 wherein a polymer is used as the hydrophilic material.

5. Method according to claim 4 wherein the hydrophilic polymer is cross-linked.

6. The method of claim 1 wherein an inorganic gel-forming substance is used as the hydrophilic material.

7. The method of claim 6 wherein the inorganic gel-forming substance is cross-linked.

8. The method according to claim 1 comprising applying the hydrophilic material to the wet surface in the form of a powder.

9. The method according to claim 1 wherein the hydrophilic material is applied to the surface in the form of a dispersion.

10. The method according to claim 1 wherein in that the hydrophilic material is applied to the surface in the form of a solution.

11. The method according to claim 1 in that the hydrophilic material contains calcium lignin sulfonate.

12. The method according to claim 1 wherein two different hydrophilic polymers are used in a non-stoichiometric ratio.

13. The method according to claim 1 comprising first coating the surface with a cationic substance and thereafter with an anionic gel-forming substance.

14. The method according to claim 1 comprising first coating with an anionic substance and, thereafter coating with a cationic gel-forming substance.

15. The method of claim 14 wherein the anionic substance is a polymer.

16. The method of claim 1 wherein the surface is asbestos cement.

17. The method of claim 16 wherein the surface is the interior of an asbestos cement pipe that is at least partially wet.

18. A ship having one or more ballast tanks treated in accordance with the method of claim 1.

19. A composition for use in protecting free surfaces, comprising a gel-forming hydrophilic material, which is essentially insoluble in water, and an inorganic gel-forming substance, together with water;

wherein the hydrophilic material is about 25% by weight calcium ligninsulfonate, about 2% by weight sodium bichromate, about 3% by weight micro-mica, and about 70% water.

20. Composition for use in protecting free surfaces, comprising a gel-forming hydrophilic material, which is essentially insoluble in water, and an inorganic gel-forming substance, together with water;

wherein the hydrophilic material is about 40% by weight melamine-formaldehyde resin, about 10% by weight phosphoric acid, about 3% by weight micro-mica, and 47% water.

21. A composition of matter for use in protecting free surfaces, comprising a gel-forming hydrophilic material, which is essentially insoluble in water and an inorganic gel-forming substance, together with water wherein the hydrophilic material is about 25% by weight urea-formaldehyde resin, about 3% by weight micro-mica and about 47% water.

22. A method for the protection of free, uncoated, metallic surfaces against corrosion comprising, first applying a cationic polymer to the surface and then applying an anionic gel former, thereby keeping the surface in a wet condition by binding a water layer to the metal surface by means of the gel-forming hydrophilic material, which after gelling and cure is essentially insoluble in water.

23. A method for the protection of free metallic steel surfaces, comprising coating the surface with zinc powder and then coating it with a hydrophilic polymer and gel, to form a water insoluble gel.

24. The method according to claim 23 wherein the gel contains corrosion inhibitors.

* * * * *